US006008442A

United States Patent [19]

Reidenbach

[11] Patent Number: 6,008,442

[45] Date of Patent: Dec. 28, 1999

[54] PICK WITH WEAR INDICATOR

[76] Inventor: Bryan L. Reidenbach, 26 Northern Dr., Millersburg, Ohio 44654

[21] Appl. No.: 09/245,326

[22] Filed: Feb. 5, 1999

[51] Int. Cl.[6] ..... G10D 3/16

[52] U.S. Cl. ..... 84/322; 84/320

[58] Field of Search ..... 84/320, 321, 322

[56] References Cited

U.S. PATENT DOCUMENTS

| | | | |
|---|---|---|---|
| D. 291,809 | 9/1987 | Jasper | D17/20 |
| 1,557,476 | 10/1925 | Kimball | 84/322 |
| 3,312,137 | 4/1967 | Oddo | 84/322 |
| 3,739,681 | 6/1973 | Dunlop | 84/322 |
| 4,102,234 | 7/1978 | Brundage | 84/322 |
| 4,878,940 | 11/1989 | Pereira | 84/322 |
| 4,993,302 | 2/1991 | Jonahan | 84/322 |
| 5,194,680 | 3/1993 | Reineck | 84/320 |
| 5,509,341 | 4/1996 | Dunlop | 84/322 |
| 5,859,377 | 1/1999 | Macket et al. | 84/322 |

*Primary Examiner*—Robert E. Nappi
*Assistant Examiner*—Kim Lockett
*Attorney, Agent, or Firm*—Sard & Sebolt

[57] ABSTRACT

A guitar pick having a body terminating at an edge, with a tip defined along a portion of the edge, includes first and second faces with first and second wear indicators disposed thereon adjacent the edge and spaced inwardly therefrom. The wear indicators provide a fixed reference against which the wear experienced by the tip can be ascertained. The wear indicators can be either lines imprinted on the first and second faces or can be raised ridges extending outwardly therefrom.

18 Claims, 4 Drawing Sheets

PICK WITH WEAR INDICATOR

BACKGROUND OF THE INVENTION

1. Technical Field

The invention relates generally to a pick for a stringed musical instrument. More particularly, the invention relates to a pick having a wear indicator. Specifically, the invention relates to a pick having a line or ridge disposed adjacent a playing surface to provide a visual indication of the extent to which the playing surface has worn away.

2. Background Information

Stringed musical instruments such as guitars, banjos and the like contain metal or plastic strings that are selectively strummed by the user to create music. The strings can be strummed by the user's fingertips although such strumming sometimes can lead to irritation, pain, and wear of the skin on the fingertips. As is understood in the relevant art, a pick is often used to selectively pluck or strum the strings of the stringed musical instrument. Such a pick typically is held between the thumb and forefinger of the playing hand or is attached to one of the fingers thereof with the tip of the pick being used to strum the strings of the musical instrument. The use of a pick in such a fashion obviates the wear and irritation otherwise caused to the fingertips.

The use of such picks has not, however, been without limitation. A pick preferably is formed with a pointed tip to permit the user to selectively strum one or more strings out of a group of closely spaced and parallel strings. Inasmuch as the pointed tip must operatively interact with metal and/or plastic strings that are tightly tensioned, the friction between the pick and the string results in incremental wear of the pointed tip of the pick. The vast majority of such picks are manufactured out of a stiff plastic material inasmuch as plastic provides the desired level of rigidity and damping to operate effectively with the vibrating strings of stringed musical instruments. Thus, wear is inevitably experienced at the tip of the pick. Such wear occurs incrementally with use and gradually impairs the performance of the pick with a resulting deleterious effect on the quality of the music produced by the stringed musical instrument. Such a worn pick may also be correspondingly difficult to play. The slow progress of the wear can often go unnoticed by the user.

Thus, it is desired to provide a pick having a wear indicator that provides a visual indication of the extent that the tip of the pick has worn away with use. Preferably, the wear indicator would be a line or raised ridge adjacent the edge and spaced inward therefrom with the tip wear appearing as an incongruity between the wear indicator and the tip.

SUMMARY OF THE INVENTION

In view of the foregoing, an objective of the invention is to provide a pick that provides a visual indication of the extent that the pick has worn with use.

Another objective of the invention is to provide a pick that allows the user to ascertain quickly the need for replacing the pick.

Another objective of the invention is to provide a method for gauging the amount of wear on a pick.

Another objective of the invention is to provide a pick for a stringed musical instrument, the pick having a wear indicator.

These and other objectives and advantages are obtained by the improved pick with wear indicator of the present invention, the general nature of which may be stated as including a body having a first face, a second face, and an edge, the first and second faces terminating at the edge, and at least a first wear indicator disposed on one of the first and second faces, the at least first wear indicator positioned adjacent the edge.

BRIEF DESCRIPTION OF THE DRAWINGS

The preferred embodiments of the invention, illustrative of the best modes in which applicant has contemplated applying the principles of the invention, are set forth in the following description and are shown in the drawings and are particularly and distinctly pointed out and set forth in the appended claims.

Similar numerals refer to similar parts throughout the specification.

DESCRIPTION OF THE PREFERRED EMBODIMENTS

Figure 1:
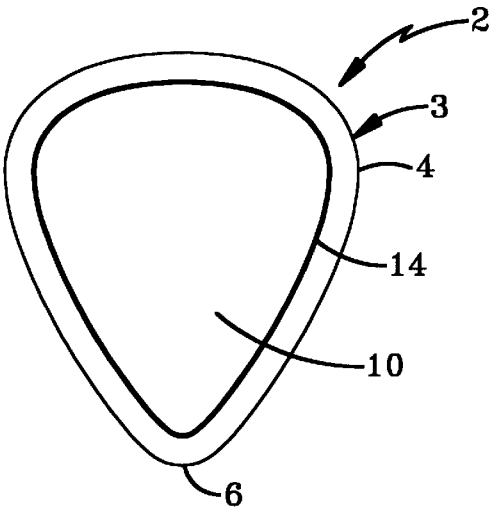
FIG. 1 is a front elevational view of a first embodiment of the pick of the present invention.
Figure 2:
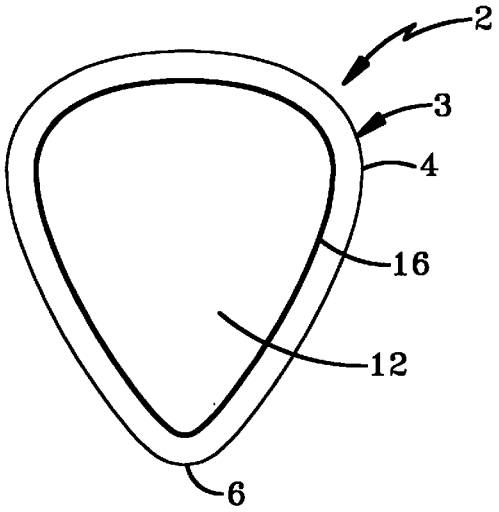
FIG. 2 is a rear elevational view of the first embodiment.
Figure 3:
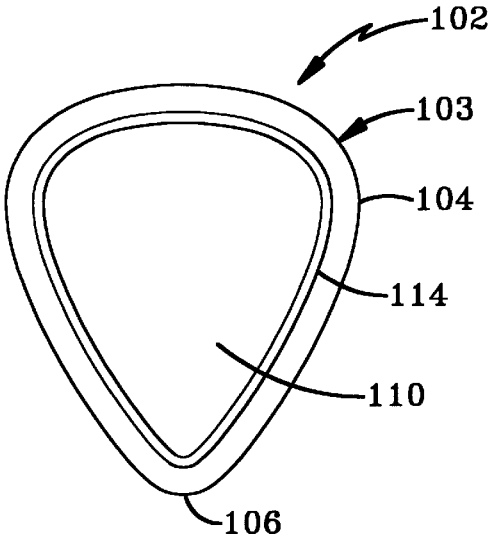
FIG. 3 is a front elevational view of a second embodiment of the pick of the present invention.
Figure 4:
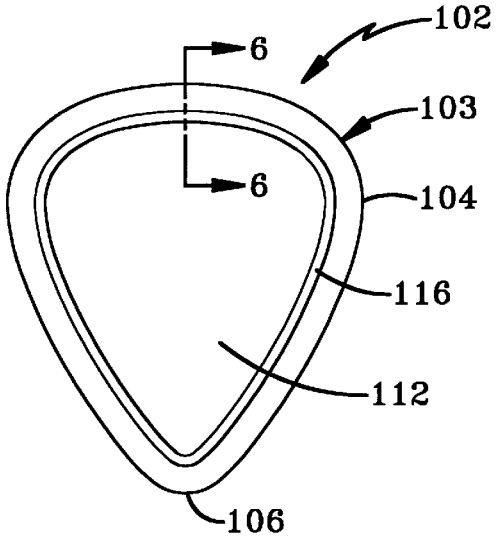
FIG. 4 is a rear elevational view of the second embodiment.
Figure 5:
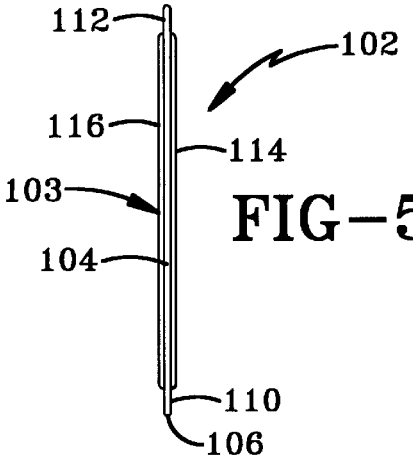
FIG. 5 is a side elevational view of the second embodiment.
Figure 6:
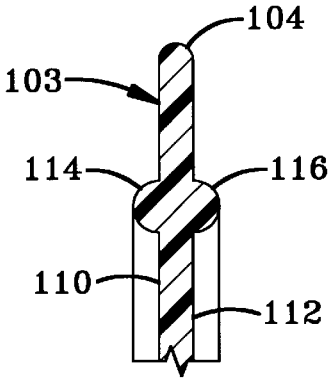
FIG. 6 is an enlarged sectional view of the second embodiment taken along line 6—6 of FIG. 4.

The pick of the present invention is indicated generally by the numeral 2 in FIGS. 1 and 2. As is understood in the relevant art, pick 2 can be used to selectively pluck or strum the strings of various musical instruments such as guitars, banjos, and the like. In the preferred embodiments, pick 2 is a guitar pick.

Pick 2 includes a body 3 that terminates at an edge 4 at the periphery thereof, with a tip 6 being defined along a portion of edge 4. Body 3 includes a first face 10 and a second face 12 opposed thereto. First and second faces 12 are substantially planar and terminate at edge 4. In use, first and second faces 10 and 12 are held by the user with tip 6 being used to pluck the guitar strings (not shown). Pick 2 is preferably constructed of a thin, rigid plastic material such as polycarbonate, nylon, or vinyl although other materials may be used with departing from the spirit of the present invention.

Figure 19:
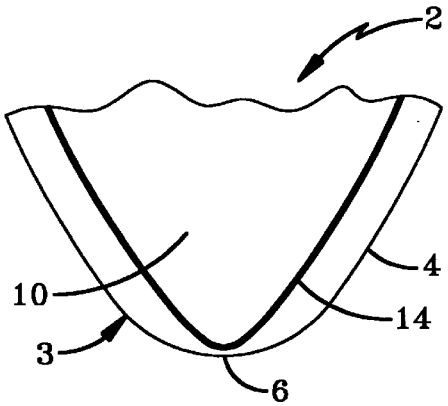
FIG. 19 is an enlarged view of a portion of the first embodiment showing the tip worn away with use.

In accordance with the objectives of the present invention, a first line 14 is disposed on first face 10, and a second line 16 is disposed on second face 12 (FIGS. 1–2). In accordance with the features of the present invention, first and second lines 14 and 16 lay adjacent to edge 4 and are spaced inward therefrom. First and second lines 14 and 16 are positioned a fixed distance from edge 4 to define a wear indicator. Inasmuch as the space between edge 4 and first and second lines 14 and 16 is constant, the wear experienced by edge 4 at tip 6 appears to the user as a region wherein edge 4 is closer to first and second lines 14 and 16 than at other locations along edge 4 (FIG. 19). In accordance with the features of the present invention, therefore, first and second lines 14 and 16 provide a fixed reference point for ascertaining the extent that tip 6 was worn. Inasmuch as first and second lines 14 and 16 are intended to provide wear indicators that stand as fixed references for checking the extent of wear of pick 2, it is understood that first and second lines 14 and 16 may be positioned adjacent edge 4 with no space therebetween (FIG. 2A) without departing from the spirit of the present invention.

First and second lines 14 and 16 can be applied to first and second faces 10 and 12 by any of a variety of known methods. Likewise, first and second lines 14 and 16 can be composed of ink or any of a wide variety of other materials known and understood in the relevant art that are appropriate and compatible with the material used to manufacture body 3.

As tip 6 gradually wears with use of pick 2, the distance between edge 4 and first and second lines 14 and 16 decreases at the worn area, with the worn area thus appearing as an incongruity between edge 4 and first and second lines 14 and 16 (FIG. 19). In accordance with the features of the present invention, the user can quickly ascertain the extent of wear experienced by tip 6 by quickly observing the relationship between edge 4 and first and second lines 14 and 16. In other embodiments wherein first and second lines 14 and 16 are positioned adjacent edge 4 without being spaced therefrom (FIG. 2A), the user can quickly ascertain the extent of wear of tip 6 by viewing the extent that first and second lines 14 and 16 have worn away with edge 4. From the foregoing, it is understood that first and second lines 14 and 16 can be of essentially any configuration so long as they are adjacent edge 4 and provide a fixed reference point for ascertaining the wear experienced by tip 6.

A second embodiment of the present invention is indicated generally by the numeral 102 in FIGS. 3–6. Pick 102 is similar to pick 2 in that pick 102 includes a body 103 terminating at an edge 104, with body 103 having first and second faces 110 and 112, respectively. A tip 106 is defined along edge 104. Pick 102 is different than pick 2 in that first ridge 114 is formed on first face 110 and a second ridge 116 is formed on second face 112 to define wear indicators thereon. First and second ridges 114 and 116 protrude from first and second faces 110 and 112 and are of approximately circular cross section (FIG. 6) although other cross sections can be employed without departing from the spirit of the present invention. First and second ridges 114 and 116 can be of nearly any cross section so long as first and second ridges 114 and 116 remain relatively visible to the user of pick 102 and do not interfere with the functioning thereof.

Figure 2A:
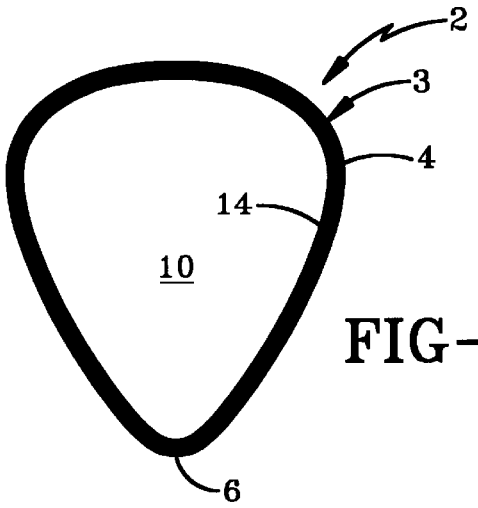
FIG. 2A is a front elevational view of the first embodiment wherein the first line is adjacent the edge without being spaced therefrom.
Figure 3A:
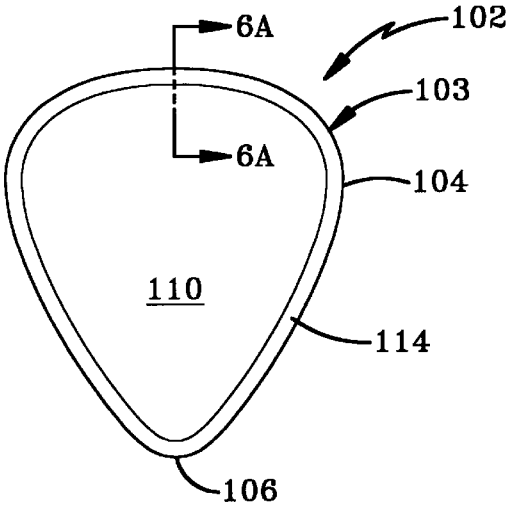
FIG. 3A is a front elevational view of the second embodiment showing the first line positioned adjacent the edge without being spaced inwardly therefrom.
Figure 6A:
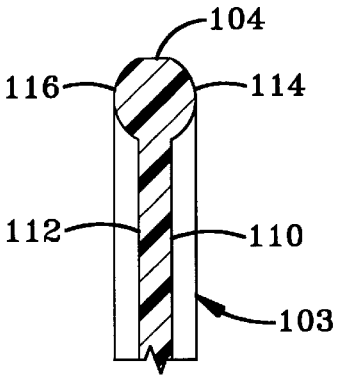
FIG. 6A is an enlarged sectional view taken along line 6A—6A of FIG. 3A.

First and second ridges 114 and 116 are elongated protrusions extending outwardly from first and second faces 110 and 112, respectively, and are preferably formed integrally therewith. Alternately, first and second ridges 114 and 116 can be a plurality of spaced protrusions in an elongated row that together define a wear indicator on first and second faces 110 and 112 (not shown). First and second ridges 114 and 116 are of a width comparable with first and second lines 14 and 16 of pick 2 and are positioned adjacent edge 104. First and second ridges 114 and 116 are preferably spaced inwardly from edge 104 a distance comparable with that by which first and second lines 14 and 16 are spaced from edge 4 of pick 2. First and second ridges 114 and 116 can alternatively be positioned adjacent edge 104 and be unspaced therefrom without departing from the spirit of the present invention (FIG. 3A). First and second ridges 114 and 116 function comparably with first and second lines 14 and 16 of pick 2 by providing wear indicators adjacent edge 104 that serve as fixed points of reference for ascertaining the wear experienced by tip 106 (FIG. 2A).

Figure 7:
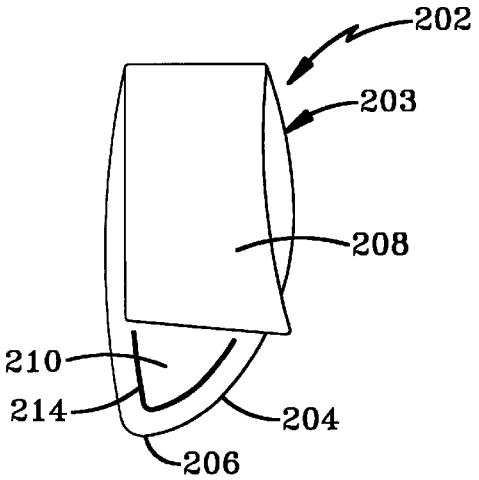
FIG. 7 is a front elevational view of a third embodiment of the pick of the present invention.
Figure 8:
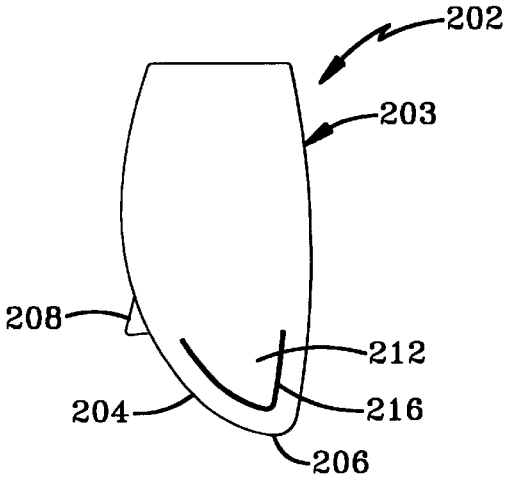
FIG. 8 is a rear elevational view of the third embodiment.
Figure 9:
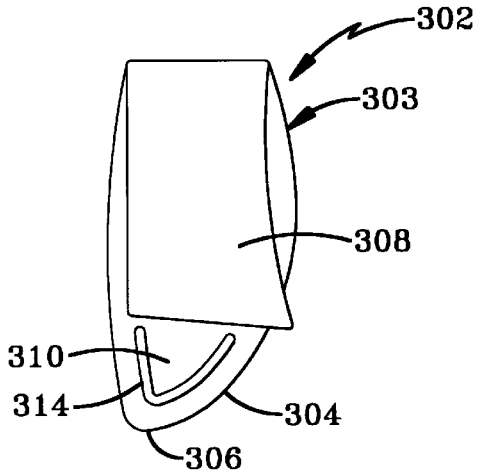
FIG. 9 is a front elevational view of a fourth embodiment of the pick of the present invention.
Figure 10:
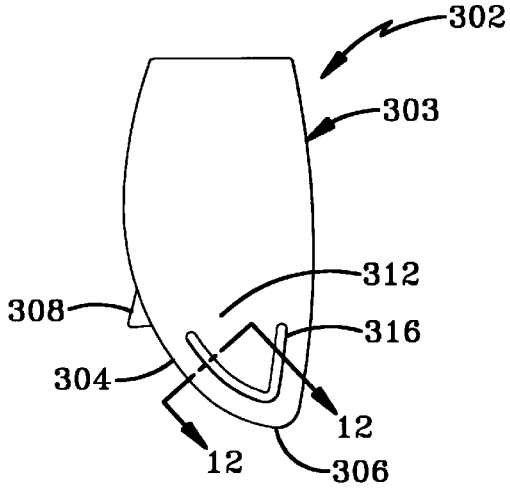
FIG. 10 is a rear elevational view of the fourth embodiment.
Figure 11:
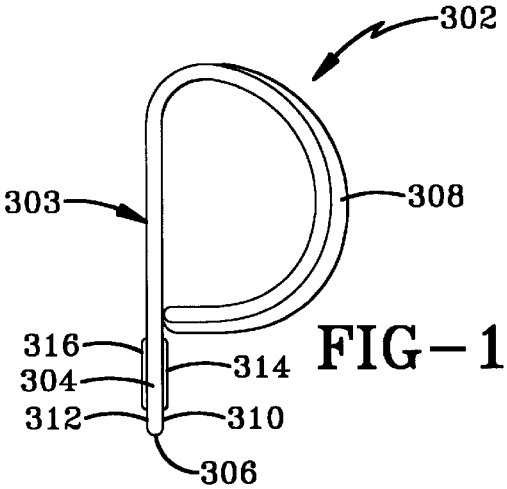
FIG. 11 is a left side elevational view of the fourth embodiment.
Figure 12:
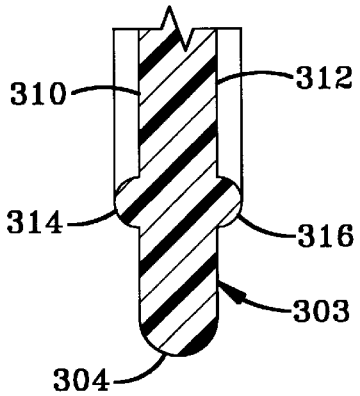
FIG. 12 is an enlarged sectional view of the fourth embodiment taken along line 12—12 of FIG. 10.

A third embodiment of the pick of the present invention is indicated by the numeral 202 in FIGS. 7–8. Pick 202 includes a body 203 terminating at an edge 204. A tip 206 is defined along a portion of edge 204 with body 203 including a thumb clip 208 attached thereto opposite tip 206. Body 203 includes a first face 210 and a second face 212, with a first line 214 disposed on first face 210 and a second line 216 disposed on second face 212, both first and second lines 214 and 216 positioned adjacent edge 204 and spaced inward therefrom.

In use, pick 202 is disposed on the user's thumb such that the thumb is positioned between body 203 and thumb clip 208. Tip 206 can thus be used to selectively pluck the strings of a guitar upon movement of the thumb. In accordance with the features of the present invention, first and second lines 214 and 216 provide a fixed point of reference for ascertaining the wear experienced by tip 206 inasmuch as first and second lines 214 and 216 are positioned adjacent edge 204. It is understood that first and second lines 214 and 216 would function equally well if they were positioned adjacent edge 204 without being spaced inwardly therefrom (not shown).

A fourth embodiment of the pick of the present invention is indicated generally by the numeral 302 in FIGS. 9–12. Pick 302 is similar to pick 202 in that it contains a body 303 terminating at an edge 304, with body 303 having a tip 306 and a thumb clip 308 opposed thereto. Pick 302 is different than pick 202 in that pick 302 includes a first ridge 314 disposed on a first face 310 and a second ridge 316 disposed on a second face 312. First and second ridges 314 and 316 are positioned adjacent edge 304 and spaced inward therefrom. First and second ridges 314 and 316 are preferably of a cross section comparable with ridges 114 and 116 but may be of other cross sections without departing from the spirit of the present invention. In accordance with the features of the present invention, first and second ridges 314 and 316 provide wear indicators for ascertaining the wear experienced by tip 306. As has been seen with regard to picks 2, 102, and 202, first and second ridges 314 and 316 need not be spaced inward from edge 304 so long as first and second ridges 314 and 316 are positioned adjacent edge 304.

Figure 13:
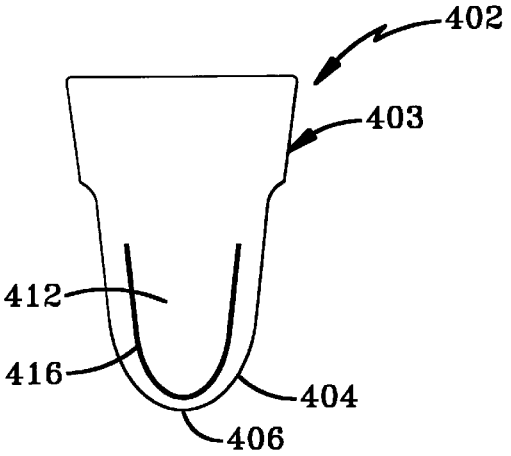
FIG. 13 is a front elevational view of a fifth embodiment of the pick of the present invention.
Figure 14:
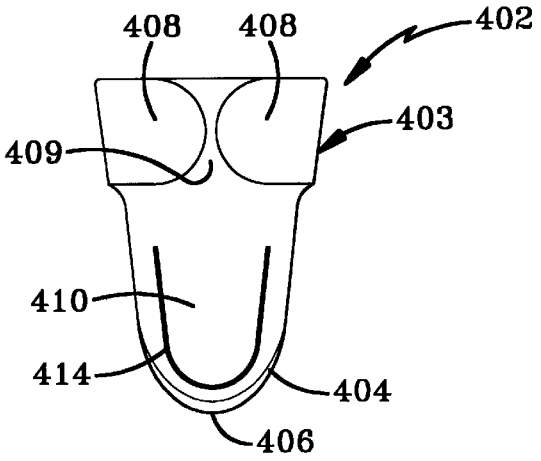
FIG. 14 is a rear elevational view of the fifth embodiment.
Figure 15:
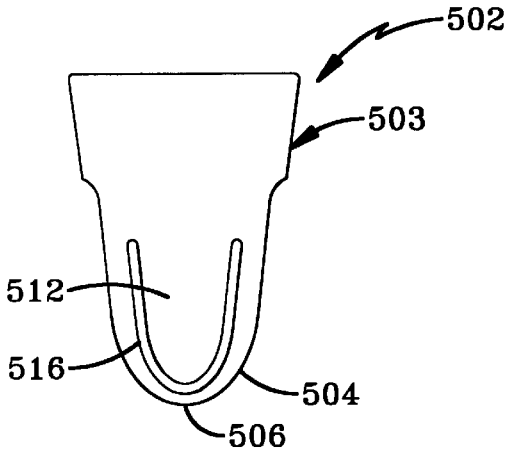
FIG. 15 is a front elevational view of a sixth embodiment of the pick of the present invention.
Figure 16:
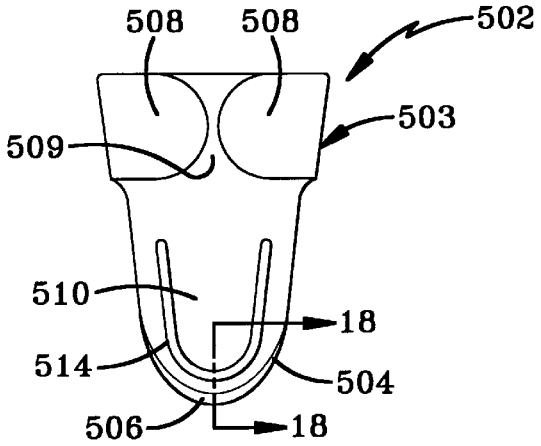
FIG. 16 is a rear elevational view of the sixth embodiment.
Figure 17:
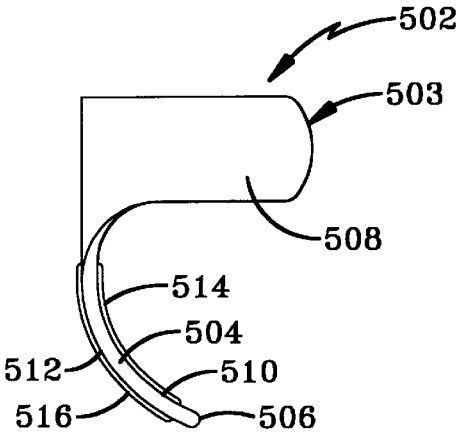
FIG. 17 is a right side elevational view of the sixth embodiment.
Figure 18:
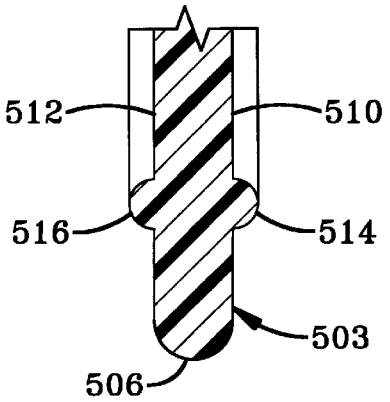
FIG. 18 is an enlarged sectional view of the sixth embodiment taken along line 18—18 of FIG. 16.

A fifth embodiment of the pick of the present invention is indicated generally by the numeral 402 in FIGS. 13–14. Pick 402 includes a body 403 terminating at an edge 404 with a tip 406 being defined along a portion of edge 404. A pair of ears 408 extend outwardly from alternate sides of body 403 and curve inwardly toward each other to define a substantially cylindrical holding zone 409 into which the user's finger is inserted prior to use. Body 403 includes a first face 410 and a second face 412 opposed thereto, with a first line 414 disposed on first face 410 and a second line 416 disposed on second face 412, first and second lines 414 and 416 being positioned adjacent edge 404 and spaced inwardly therefrom.

In accordance with the objectives of the present invention, first and second lines 414 and 416 provide a fixed reference against which the wear experienced by tip 406 can be ascertained. It is understood that first and second lines 414 and 416 could function equally well as wear indicators if they were not spaced inwardly from edge 404 so long as first and second lines 414 and 416 are positioned adjacent edge 404.

A sixth embodiment of the pick of the present invention is indicated generally by the numeral 502 in FIGS. 15–18. Pick 502 is similar to pick 402 in that it includes a body 503 terminating at an edge 504, with a tip 506 defined along a portion of edge 504. A pair of ears 508 extend outwardly from body 503 to define a holding zone 509 into which the user's finger is inserted prior to use. Pick 502 is different than pick 402 in that first face 510 includes a first ridge 514 disposed thereon and second face 512 includes a second ridge 516 disposed thereon, first and second ridges 514 and 516 positioned adjacent edge 504 and spaced inwardly therefrom. Ridges 514 and 516 function similarly to ridges 114 and 116 of pick 102. In accordance with the features of the present invention, it is understood that first and second ridges 514 and 516 could function as wear indicators even if they were not spaced inwardly from edge 504 so long as first and second ridges 514 and 516 are positioned adjacent edge 504.

Figure 20:
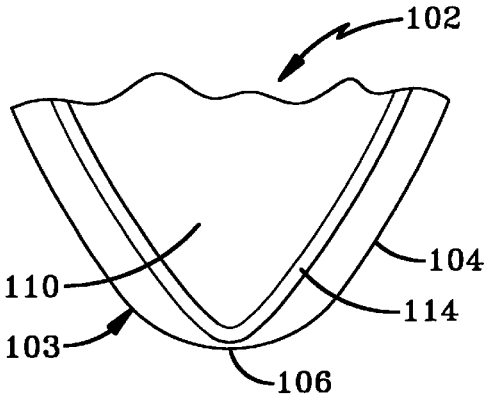
FIG. 20 is an enlarged view of a portion of the second embodiment showing the tip worn away with use.

Thus, as can be seen in FIGS. 19 and 20, the wear indicators imprinted or formed on the pick of the present invention display an incongruity between the wear indicator and the tip as the tip wears away with use. The wear indicators formed on the pick of the present invention thus provide an expedient visual indicator to permit the user to ascertain the extent that the tip has worn away with use. A musician can, therefore, replace the pick prior to a performance instead of using a worn pick and determining in the middle of a performance that the pick is in need of replacement. In accordance with the features of the present invention, therefore, the wear indicators disposed on the pick of the present invention permit a pick to be replaced by the user prior to the time the worn pick will hamper or inhibit the functioning or performance of the stringed musical instrument.

Accordingly, the improved pick with wear indicator apparatus is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness, and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries, and principles of the invention, the manner in which the pick with wear indicator is constructed and used, the characteristics of the construction, and the advantageous new and useful results obtained; the new and useful structures, devices, elements, arrangements, parts, and combinations are set forth in the appended claims.

I claim:

1. A pick for plucking a string of a musical instrument, said pick comprising:

a body having a first face, a second face, and an edge, said first and second faces terminating at said edge; and at least a first wear indicator disposed on one of said first and second faces, said at least first wear indicator positioned adjacent said edge, said at least first wear indicator adapted to indicate the extent to which said edge has worn away.

2. The pick as set forth in claim 1, further comprising a tip defined along said edge, said wear indicator positioned adjacent said tip.

3. The pick as set forth in claim 2, further comprising a second wear indicator disposed on the other of said first and second faces, said second wear indicator positioned adjacent said tip.

4. The pick as set forth in claim 3 wherein said first and second wear indicators are lines.

5. The pick as set forth in claim 4 wherein said first and second wear indicators are spaced inwardly from said edge.

6. The pick as set forth in claim 5, further comprising a thumb clip.

7. The pick as set forth in claim 5, further comprising at least a first ear.

8. The pick as set forth in claim 3 wherein said first and second wear indicators are ridges that protrude outwardly from said first and second faces.

9. The pick as set forth in claim 8 wherein said first and second wear indicators are spaced inwardly from said edge.

10. The pick as set forth in claim 9, further comprising a thumb clip.

11. The pick as set forth in claim 9, further comprising at least a first ear.

12. A pick for plucking a string of a musical instrument, said pick comprising:

a body having a first face, a second face, and an edge, said first and second faces terminating at said edge;

at least a first line disposed on one of said first and second faces, said at least first line positioned adjacent said edge; and said at least first line defining a wear indicator, said wear indicator adapted to indicate the extent to which said edge has worn away.

13. The pick as set forth in claim 12, further comprising a tip defined along said edge, said at least first line positioned adjacent said tip.

14. The pick as set forth in claim 13, further comprising a second line disposed on the other of said first and second faces, said second line positioned adjacent said tip.

15. The pick as set forth in claim 14 wherein said first and second lines are spaced inwardly from said edge.

16. A pick for plucking a string of a musical instrument, said pick comprising:

a body having a first face, a second face, and an edge, said first and second faces terminating at said edge;

a tip defined along said edge;

at least a first ridge disposed on and protruding outwardly from one of said first and second faces, said at least first ridge positioned adjacent said edge; and said at least first ridge defining a wear indicator, said wear indicator adapted to indicate the extent to which said edge has worn away.

17. The pick as set forth in claim 16, further comprising a second ridge disposed on the other of said first and second faces, said second ridge positioned adjacent said tip.

18. The pick as set forth in claim 17 wherein said first and second ridges are spaced inwardly from said edge.

* * * * *